US008059038B2

(12) United States Patent
Pohjonen

(10) Patent No.: US 8,059,038 B2
(45) Date of Patent: Nov. 15, 2011

(54) LOW LOSS LAYERED COVER FOR AN ANTENNA

(75) Inventor: Helena Pohjonen, Espoo (FI)

(73) Assignee: Nokia Corporation, Espoo (FI)

( * ) Notice: Subject to any disclaimer, the term of this patent is extended or adjusted under 35 U.S.C. 154(b) by 447 days.

(21) Appl. No.: 12/224,934

(22) PCT Filed: Mar. 8, 2006

(86) PCT No.: PCT/FI2006/000080

§ 371 (c)(1),
(2), (4) Date: Jan. 9, 2009

(87) PCT Pub. No.: WO2007/101902

PCT Pub. Date: Sep. 13, 2007

(65) Prior Publication Data

US 2009/0224985 A1 Sep. 10, 2009

(51) Int. Cl.
*H01Q 1/24* (2006.01)

(52) U.S. Cl. ..... 343/702; 343/872

(58) Field of Classification Search ..... 343/702, 343/872, 873

See application file for complete search history.

(56) References Cited

U.S. PATENT DOCUMENTS

| | | | | |
|---|---|---|---|---|
| 3,110,030 | A * | 11/1963 | Cole, Jr. | 343/792.5 |
| 5,206,083 | A * | 4/1993 | Raj et al. | 428/323 |
| 5,455,596 | A | 10/1995 | Higashiguchi et al. | |
| 5,662,293 | A * | 9/1997 | Hower et al. | 244/133 |
| 5,844,523 | A * | 12/1998 | Brennan et al. | 343/700 MS |
| 2004/0244397 | A1 | 12/2004 | Kim | |

FOREIGN PATENT DOCUMENTS

| | | | |
|---|---|---|---|
| CN | 1355576 | A | 6/2002 |
| CN | 1573651 | A | 2/2005 |
| DE | 3632128 | | 4/1988 |
| DE | 197 24 320 | | 12/1998 |
| FR | 2 713 139 | | 6/1985 |
| JP | 57-079711 | | 5/1982 |
| JP | 2000-114832 | | 4/2000 |
| JP | 2003198230 | | 7/2003 |
| WO | 2005/034286 | | 4/2005 |

OTHER PUBLICATIONS

Patent Abstracts of Japan, Publication No. 2003198230, Publication Date: Jul. 11, 2003, 1 page.

"Complex Permittivity Measurements of Common Plastics Over Variable Temperatures" by Bill Riddle et al; IEEE Transactions on Microwave Theory and Techniques, Mar. 2003, vol. 51, No. 3, pp. 727-733.

Patent Abstracts of Japan, Pub. No. 57-079711, Pub. Date: May 19, 1982, 1 page.

Patent Abstracts of Japan, Pub. No. 2000-114832, Pub. Date: Apr. 21, 2000, 1 page.

(Continued)

*Primary Examiner* — Hoanganh Le

(57) ABSTRACT

A portable radio device is shown with an outer cover (202) and a radiating antenna element (206, 207, 208, 226, 227) inside the outer cover (202). At a location corresponding to the location of the radiating antenna element (206, 207, 208, 226, 227), there is thermoplastic material (203, 215, 217, 219) the loss tangent value of which is less than 0.005. The outer cover (202) has, on the outer surface thereof and at a location corresponding to the location of the radiating antenna element (206, 207, 208, 226, 227), a coating (204, 209, 216, 218, 220) that is one of: diamond coating, diamond-like coating, diamond-based nanocomposite coating.

18 Claims, 3 Drawing Sheets

OTHER PUBLICATIONS

English Abstract, Pub. No. FR 2713139, Pub. Date: Jun. 9, 1995, 1 page.
Machine Translation JP 2003198230, Published Jul. 11, 2003, 16 pages.
English Abstract, Pub. No. DE 19724320, Published Dec. 17, 1998, 1 page.
English Abstract, Pub. No. DE 3632128 A1, Published Apr. 7, 1988, 1 page.
Chinese Office Action dated Apr. 25, 2011 in corresponding Chinese Patent Application No. 200680053720.8 (7 pages) and English translation of Chinese Office Action (10 pages).
English Abstract of Chinese Patent No. CN 1573651(A), published Feb. 2, 2005 (1 page).
English Abstract of Chinese Patent No. CN 1355576(A), published Jun. 26, 2002 (1 page).

* cited by examiner

LOW LOSS LAYERED COVER FOR AN ANTENNA

TECHNICAL FIELD

The invention concerns generally the technology of antennas for portable radio devices and devices including radio functionality. Especially the invention concerns the selection of cover materials and structures for the portable radio device or devices including radio functionality in order to enhance antenna efficiency.

BACKGROUND OF THE INVENTION

Portable radio devices typically comprise an internal antenna, which means that the radiating antenna element is located within the smooth overall outline of the device, without the antenna causing any protrusions, and enclosed inside an essentially continuous outer cover of the device. The outer cover should naturally cause as little attenuation of radio waves as possible, so that it would allow the antenna to freely receive and transmit radio frequency transmissions. The radiating antenna element is typically flat and comprises conductive sections, strips and/or patches. A ground plane is needed inside the radio device and relatively near to the radiating antenna element to achieve proper operation.

A prior art publication WO 2005/034286 discloses a combined antenna and cover structure for a portable radio device. A central idea of the invention is to "bake" the radiating antenna element into the material of the outer cover, and to use a capacitive feed to couple it to the antenna port of the transceiver. A relatively similar solution is known from the publication EP 1 439 602, which mentions that the radiating antenna element may also comprise of a foil or other conductive material attached to an inner surface of the outer cover. A publication JP 2000114832 discloses an antenna structure, in which the antenna is a of the built-in planar type, although a protruding part of the outer cover is separately provided for it in order to bring the antenna away from the attenuating shadow of other components in the portable radio device. A prior art publication JP 57-79711 suggests placing the planar antenna at the outer surface of the outer cover. A yet another prior art publication U.S. Pat. No. 5,455,596 introduces various antenna modules that can be used in portable radio devices.

A problem of the known prior art antennas of the kinds described above is the effect of radio frequency losses in the cover materials. Losses in the radiating antenna element itself are typically not of importance, because it is relatively easy to make the radiating antenna element from a sufficiently thick layer of sufficiently conductive material, such as copper, so that radio frequency losses are to a large extent eliminated. The cover material, on the other hand, has traditionally been selected on other grounds than low RF losses. A vast majority of outer covers for portable radio devices are manufactured by injection molding. The material used for an injection molded outer cover must naturally have properties that are advantageous in the process. Also, the completed outer cover must have sufficient mechanical stiffness and durability as well as dimensional accuracy, and it must serve as a good basis for surface treatments such as decorative painting.

In prior art literature the problem of losses appears at most in the form of abstract statements. Publication WO 2005/034286 calls for "a material with as low losses as possible"; the publication U.S. Pat. No. 5,455,596 speaks about a "curable dielectric resin film". It is often customary to characterize the losses of various dielectric materials with their relative electric permittivity, also designated as the dielectric constant of the material. However, a better measure of the actual losses is the so called dielectric loss tangent (tan d), which is the imaginary part of the dielectric constant divided by the real part of the dielectric constant. The dielectric loss tangent is typically frequency dependent. As an example, the commonly used low-frequency circuit board material FR-4 has a relative permittivity between 4.1 and 4.5, and a loss tangent value of about 0.02 at 1 MHz, while high-frequency circuit board materials such as DiClad® made by Arlon Materials for Electronics has a relative permittivity between 2.17 and 2.65 and a loss tangent value between 0.0008 and 0.0022 in the range from 1 MHz to 10 GHz.

The most common materials used for injection molding are acrylonitrile-butadiene-styrene (ABS), polycarbonate (PC), high-density polyethylene (HDPE), poly-methyl-methacrylate (PMMA), polypropylene (PP), polystyrene (PS), and polyvinyl chloride (PVC). Loss tangent values for these materials in their pure forms are found in B. Riddle, J. Baker-Jarvis, J. Krupka: "Complex Permittivity Measurements of Common Plastics Over Variable Temperatures", IEEE Transactions on Microwave Theory and Techniques, Vol. 51, No. 3, pp. 727-733, Mar. 2003. Approximate values for frequencies around 10-11 GHz and room temperature are the following: ABS 0.006-0.009, PC 0.0004-0.0006, HDPE 0.0001-0.0002, PMMA 0.006-0.01, PP 0.00007-0.0001, PS 0.0004-0.0006, and PVC 0.005-0.008. In many cases the material used for an injection molded object is a mixture of at least two different kinds of plastic. Reinforcement materials such as glass fibers or the like can be mixed to the plastic to achieve suitable mechanical properties.

The prior art problem of losses in the dielectric outer cover material is made worse by environmental conditions, which cause e.g. moisture and impurities to get absorbed in the outer cover material, which tends to increase the original loss tangent value of the material. Yet another problem of the prior art antenna structures is that if the portable radio device is transmitting at full power, losses in the antenna structure may cause local heating, which the user feels through the outer cover. Users do not like to feel such local heating, because they easily associate it with assumed malfunctioning of the device.

SUMMARY OF THE INVENTION

An objective of the present invention is to present an antenna structure for portable radio devices, which has low losses and good reliability in operation. Another objective of the invention is to present an antenna structure that increases the convenience of use to a human user.

The objectives of the invention are achieved by making the outer cover of a portable radio device to comprise at least partly of a very low loss thermoplastic material, and coating it at least partly with a diamond-, diamond-like or nanocomposite coating.

A portable radio device according to the invention comprises an outer cover and a radiating antenna element inside said outer cover, preferably embedded to the material of said outer cover. It is characterized in that the outer cover comprises, at a location corresponding to the location of the radiating antenna element, thermoplastic material the loss tangent value of which is less than 0.005; and the outer cover comprises, on the outer surface thereof and at a location corresponding to the location of the radiating antenna element, a coating that is one of: diamond coating, diamond-like coating, diamond-based nanocomposite coating.

An outer cover part according to the invention is characterized in that it comprises, at a location adapted to correspond to the location of a radiating antenna element in the portable radio device, thermoplastic material the loss tangent value of which is less than 0.005; and the outer cover part comprises, on the outer surface thereof and at a location adapted to correspond to the location of said radiating antenna element in the portable radio device, a coating that is one of: diamond coating, diamond-like coating, diamond-based nanocomposite coating.

An antenna structure of the invention is characterized in that it comprises, at a location adapted to correspond to the location of a radiating antenna element in the portable radio device, thermoplastic material the loss tangent value of which is less than 0.005; and the outer cover part comprises, on the outer surface thereof and at a location adapted to correspond to the location of said radiating antenna element in the portable radio device, a coating that is one of: diamond coating, diamond-like coating, diamond-based nanocomposite coating.

A radio frequency module according to the invention comprises an outer cover and a radiating antenna element inside said outer cover, preferably embedded to the material of said outer cover. It is characterized in that the outer cover comprises, at a location corresponding to the location of the radiating antenna element, thermoplastic material the loss tangent value of which is less than 0.005; and the outer cover comprises, on the outer surface thereof and at a location corresponding to the location of the radiating antenna element, a coating that is one of: diamond coating, diamond-like coating, diamond-based nanocomposite coating.

A manufacturing method according to the invention comprises producing an outer cover part and producing a radiating antenna element inside said outer cover part. It is characterized in that it comprises making the outer cover part comprise, at a location corresponding to the location of the radiating antenna element, thermoplastic material the loss tangent value of which is less than 0.005, and coating at least part of the outer surface of the outer cover part, at a location corresponding to the location of the radiating antenna element, with a coating that is one of: diamond coating, diamond-like coating, diamond-based nanocomposite coating.

The losses caused by the dielectric materials surrounding a radiating antenna element may depend more heavily on the material's loss tangent value than what the manufacturers of portable radio devices have realized. Simulations show that lowering the loss tangent value by a decade may increase antenna efficiency by tens of percentage units, up to a limit that appear to be achieved close to a loss tangent value 0.005. It is therefore advisable to use a cover material with such low RF loss characteristics at least close to those parts of the cover of a portable radio device where significant amounts of radio frequency radiation will go through. Suitable materials are at least polyolefin based resins.

A coating of a suitable kind may significantly enhance the properties of the low-loss cover material. Diamond coatings, diamond-like coatings and diamond-based nanocomposite coatings have many advantageous features in this respect. They are extremely durable against external wear, and they increase the material strength of the underlying polymer material. They conduct heat very well, which effectively distributes any locally occurred heating over a wide area, thus decreasing the possibility of the user conceiving any inconvenient hot spots. They even provide a very agreeable outer appearance and can be painted or lacquered if needed.

The exemplary embodiments of the invention presented in this patent application are not to be interpreted to pose limitations to the applicability of the appended claims. The word "comprise" is used in this patent application as an open limitation that does not exclude the existence of also unrecited features. The features recited in depending claims are mutually freely combinable unless otherwise explicitly stated.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
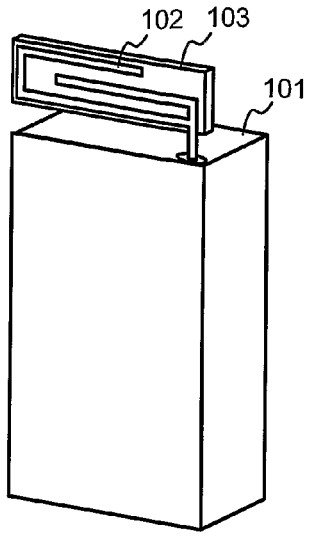
FIG. 1 illustrates a simulation model of a portable radio device.

FIG. 1 is a schematic illustration of a configuration for which certain simulation calculations were made. A portable radio device 101 has an antenna, in which a radiating antenna element 102 is attached to a dielectric plate 103, which simulates an outer cover part. In the simulation it was assumed that the dielectric plate 103 is 1 millimeter thick and made of material with relative permittivity 1 (which, to be exact, is only true for vacuum, but constitutes an acceptable approximation since the simulation only illustrates the effect of the loss tangent value). The following table shows the effect of the loss tangent value of the material of the dielectric plate in five cases. We use the designation "tan d" for the loss tangent value.

| Case | Antenna efficiency |
|---|---|
| No dielectric plate | 80.92% |
| Dielectric plate with tan d = 0.005 | 79.25% |
| Dielectric plate with tan d = 0.015 | 75.25% |
| Dielectric plate with tan d = 0.04 | 66.61% |
| Dielectric plate with tan d = 0.08 | 56.16% |

The table shows that a dielectric plate attached to the radiating antenna element has a significant negative effect on antenna efficiency, if the loss tangent value of the material of which the dielectric plate is made is higher than 0.005. Thus, if a portable telephone device has a radiating antenna element attached to or close to an outer cover part, it is advisable to make said outer cover part of a material with a loss tangent value less than about 0.005. This value is not an exact limit, but merely serves to illustrate the order of magnitude at which the loss tangent value becomes acceptable in terms of only very little additional loss caused to the antenna.

Examples of materials that are well suited for injection molding and other large-scale methods of precision manufacturing of plastic components, and have a suitably low loss tangent value, include but are not limited to polyolefin based thermoplastic resins. In view of the measurement results presented in the scientific paper mentioned above in the description of prior art, it is also possible to use PC (tan d between 0.0004-0.0006), PS (tan d between 0.0004-0.0006), and possibly PVC (tan d between 0.005-0.008), at least as components of a mixed thermoplastic.

Figure 2A:
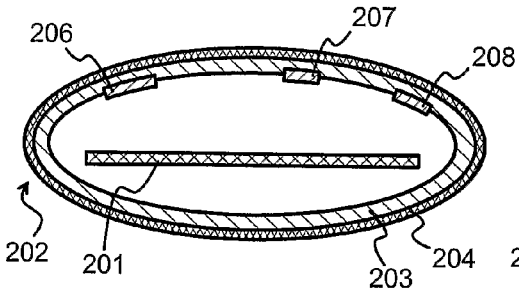
FIGS. 2*a*, 2*b*, 2*c* and 2*d* illustrate schematically various structural configurations.

FIGS. 2*a*, 2*b*, 2*c* and 2*d* illustrate schematically various ways of how a low loss thermoplastic and a diamond-, diamond-like- or nanocomposite coating with diamond structure can be used to enhance the properties of an antenna arrangement. FIG. 2*a* is a schematic cross section, in which we assume that inside a portable radio device there are some radio frequency components (not separately shown) and a ground plane 201. An outer cover, generally designated as 202, comprises at least two layers. An inner layer 203 is made of a thermoplastic material having a loss tangent value smaller than 0.005. An outer layer 204 is made of artificial diamond, diamond-like carbon, or nanocomposite material. The antenna arrangement for the radio frequency components comprises one or more radiating antenna elements, of which elements 206, 207, and 208 are shown. The way in which feed connections are made to the radiating antenna elements is not important to the present invention and thus has not been separately shown in FIG. 2*a*.

Figure 2B:
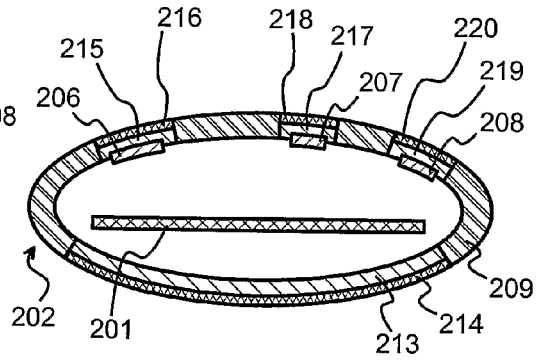

FIG. 2*b* illustrates another embodiment, in which the ground plane 201 and the: antenna elements 206, 207 and 208 are similar to those in FIG. 2*a*. Instead of making the whole outer cover 202 consist of the low-loss thermoplastic the embodiment 2*b* implements a patchwork solution, where the outer cover 202 comprises a frame part 209 made of a material that is selected on other grounds than low RF loss—for example advantageous price, better mechanical properties, nicer outer appearance or the like. At a location that corresponds to the location of the ground plane 201 the outer cover comprises a patch 213 of a low-loss thermoplastic, covered with a diamond-, diamond-like-, or nanocomposite coating patch 214. Similarly, at locations that correspond to the locations of the antenna elements 206, 207 and 208 there are low-loss thermoplastic patches 215, 217 and 219 respectively, covered with diamond-, diamond-like-, or nanocomposite coating patches 216, 218 and 220 respectively. If we can safely assume that a large majority of the radio waves will travel to and from that direction to which the antenna elements 206, 207 and 208 look, the low-loss thermoplastic patch 213 and its coating patch 214 on the ground plane side are not absolutely necessary. However, especially in multi-standard wireless access products with a minimum number of explicitly designated radiating antenna elements situations frequently arise where (parts of) the ground plane(s) acts as a radiating antenna. Bearing this possibility in mind it is more advantageous to have the low-loss cover material also on the ground plane side.

We should note that the drawings are not to scale. Typical (but non-limiting) thicknesses of the layers involved are 0.15 to 1 millimeters for the ground planes and radiating antenna elements, 0.3 to 2 millimeters for the low-loss thermoplastic parts and frame parts, and 0.1 to 10 micrometers for the diamond-, diamond-like-, or nanocomposite coating. Thus considering the real scale there is little importance to the fact, whether the coating layers are drawn to appear in some kind of indents like in FIG. 2*b*, or whether all parts 209, 213, 215, 217, and 219 are equally thick (which is likely to be the case in reality).

Figure 2C:
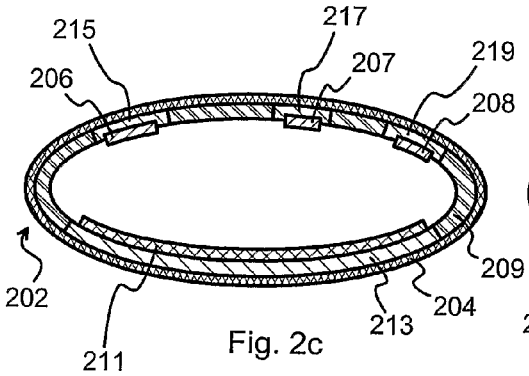
Figure 2D:
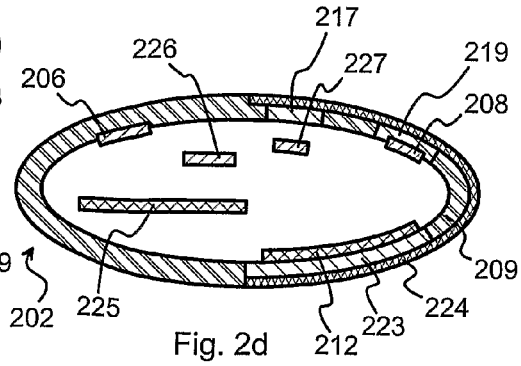

FIGS. 2*c* and 2*d* illustrate some variations to the embodiments of FIGS. 2*a* and 2*b*. In FIG. 2*c* the ground plane 211 is not planar but conforms to the form of the inner surface of the outer cover 202. Also the ground plane 211 is not located at a distance from the inner surface of the outer cover 202 but directly attached to it. Another difference to FIG. 2*b* is that although the low-loss thermoplastic only appears as patches 213, 215, 217, and 219 in the frame part 209 of other material, the coating 204 is continuous over both materials and thus resembles the coating 204 of FIG. 2*a*.

FIG. 2*d* illustrates a case where not all antenna parts of the portable radio device are equipped with the low-loss thermoplastic cover layers. The ground plane of the device is not uniform but split into parts, of which parts 212 and 225 are shown. Of these, part 212 conforms to the form of the inner surface of the outer cover 202 and is directly attached to it, and part 225 has some other form (here straight planar) and is located at a distance from the inner surface of the outer cover 202. A low-loss thermoplastic patch 223 occurs at the location of only some of the ground plane parts, here part 212 (could also be the other way round). There are several radiating antenna elements, of which elements 206 and 208 are attached to the inner surface of the outer cover 202 while elements 226 and 227 are located at a distance from the inner surface of the outer cover 202. Low-loss thermoplastic patches 217 and 219 co-exist with radiating antenna elements 227 and 208 respectively, while radiating antenna elements 206 and 226 must communicate through the frame part 209 made of some other material, which is transparent to radio waves but not with as low losses as the low-loss thermoplastic material. A diamond-, diamond-like-, or nanocomposite coating 224 covers some parts of the outer cover 202; here the low-loss thermoplastic patches 217, 219, and 223 as well as some of the frame part material.

A non-uniform diamond-, diamond-like-, or nanocomposite coating, meaning that it only covers parts of the outer cover, could naturally be used also in the case where the whole outer cover or at least a major part of it was made of the low-loss thermoplastic like in FIG. 2*a*. Parts of the low-loss thermoplastic may be exposed to outside without having a coating on it.

The role of the ground plane or ground planes is to provide the ground potential level for electric components of the portable radio device and to carry the associated currents. Ground plane parts are made of materials having excellent electric conductivity, typically metals such as copper. Radiating antenna elements are, as already their designation indicates, the parts of the antenna structure that transmit and receive the most of the electromagnetic radiation at radio frequencies. The invention does not limit the form or operating principle of the radiating antenna elements. Typically they constitute the radiating part of a PIFA (planar inverted F antenna) or a PILA (planar inverted L antenna). They are also made of good electric conductor materials.

The low-loss thermoplastic parts have several functions. From the viewpoint of antenna operation, the low-loss thermoplastic material constitutes a radiation window that is essentially transparent (i.e. causes only a very little amount of dielectric loss) to radio waves. From a structural viewpoint the low-loss thermoplastic also constitutes the form of the outer cover at the locations where it exists, and provides the required mechanical strength, stiffness and support to parts attached to the outer cover. In embodiments where at least one other outer cover material is used (see frame part 209 in FIGS. 2*b* to 2*d*), this material has the same structural functions.

The diamond-, diamond-like-, or nanocomposite coating has also several functions. Artificially produced diamond and diamond-like carbon layers as well as nanocomposite materials based on these are very hard, so the coating layer adds hardness to the surface of the outer cover. Hardness increases the resistance of the outer cover against external wear, especially scratching. If the coating layer is sufficiently thick, it adds overall mechanical strength to the thermoplastic materials underneath it. The smooth and hard surface also provides a sleek visual appearance and a pleasant tactile feeling. Diamond and is a good insulator at room temperature, which means that the coating does not alter the advantageous dielectric characteristics of the low-loss thermoplastic material. A uniform coating of this kind that covers a low-loss thermoplastic material also protects it from moisture and other absorptive impurities, which otherwise could weaken its dielectric characteristics over time. If needed the outermost coating can be painted or lacquered.

One exceptional characteristic of the diamond-based coating is its exceptionally good thermal conductivity. This is an advantageous property in cases where the coating covers significantly more of the surface of the outer cover than just a radiating antenna element. If power is dissipated in the radiating antenna element, causing its temperature to rise, the heat will be conducted through the low-loss thermoplastic to the coating layer, which spreads it over an area that is considerably larger than just the radiating antenna element. It is assumed that the coating may result in surface temperatures up to 10 degrees centigrade lower at the location of the radiating antenna element than what would be obtained with an outer cover consisting solely of a thermoplastic. It is thus much less probable that a human user will feel any local hot spot on the cover of the portable radio device, or experience it as disturbing. The heat-distributing effect is a good reason for making the coating patches of even solutions like that shown in FIG. 2*b* significantly larger than the underlying antenna elements.

A coating can be said to be a consist of diamond coating if the relative portion of sp3-hybridized carbon atoms contained in the coating material is high enough to be clearly dominant. A diamond coating produced in a chemical vapour deposition (CVD), ion beam deposition or sputter deposition process is a polycrystalline or nanocrystalline substance, where varying amounts of amorphous carbon hold together a large number of unoriented diamond crystallites. If the relative portion of sp2-hybridized carbon atoms in the material grows, the coating material begins to be diamond-like rather than pure diamond. There is no exact limit between the two. A diamond-like material where a significant portion of the sp2-hybridized carbon atoms have also a bond to a proton (a hydrogen atom) is frequenctly referred to as a-C:H or Ta—C:H. Nanocomposite is a general definition of mixed material solids where the inhomogeneity is observed at submicron scale and where the component substances may have different functions. For the purposes of the present invention, a nanocomposite coating is one where an essential part of the basic material is amorphous diamond or diamond-like.

Figure 3:
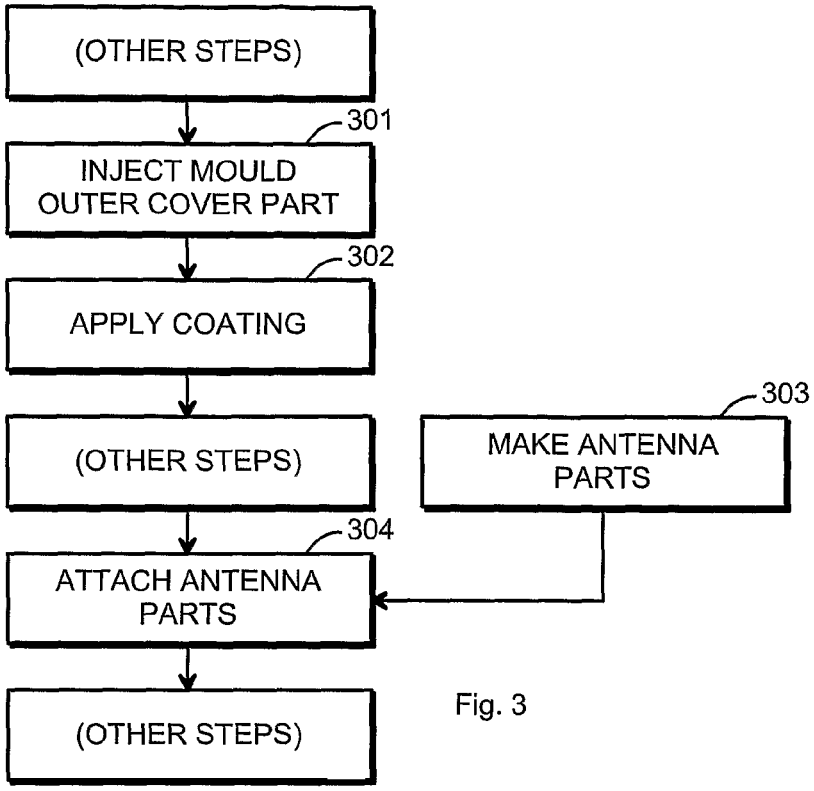
FIG. 3 illustrates a manufacturing method according to an embodiment of the invention.

FIGS. 3 to 6 illustrate various exemplary manufacturing methods according to embodiments of the invention. In FIG. 3 step 301 involves manufacturing an outer cover part of a low-loss thermoplastic material. Step 302 involves applying a diamond-, diamond-like-, or nanocomposite coating to cover at least parts of the outer surface of the outer cover part. Suitable processes for step 302 are those where the coated object does not need to be heated to temperatures that would excessively soften the thermoplastic material. CVD coating processes with temperatures less than 70 degrees centigrade are known and commercially available at least from Diarc Oy in Finland. The process should also be one where the diamond coating can be made without eventual internal compressive stress, which could cause flaking. Stress-free diamond coating technology at room temperature is known to be available at least from Sandia National Laboratories in New Mexico, USA.

In FIG. 3 we assume that the radiating antenna elements and ground planes are separately manufactured in step 303, and at least some of the radiating antenna elements are attached to at least some of the outer cover parts in step 304.

Figure 4:
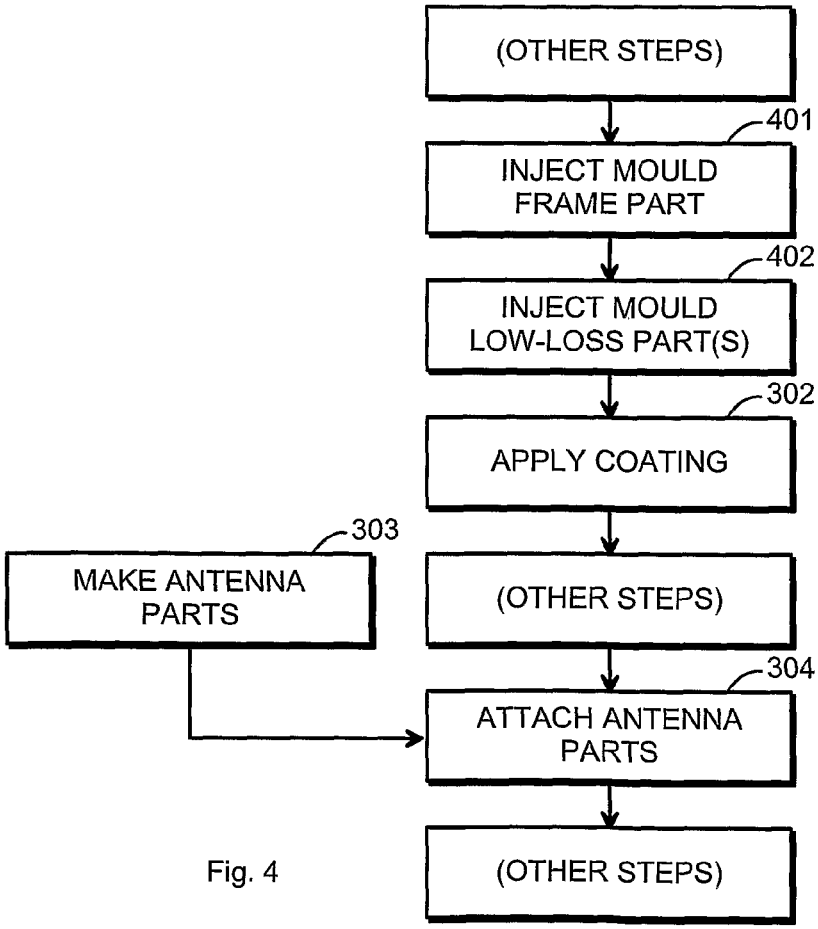
FIG. 4 illustrates another manufacturing method according to an embodiment of the invention.

The method of FIG. 4 is different in that the frame part is injection molded first in step 401, and the low-loss thermoplastic parts are injection molded separately in step 402. Otherwise the application of the diamond-, diamond-like-, or nanocomposite coating in step 302, making the antenna parts in step 303 and attaching at least some of the antenna parts in step 304 are the same as in FIG. 3.

Figure 5:
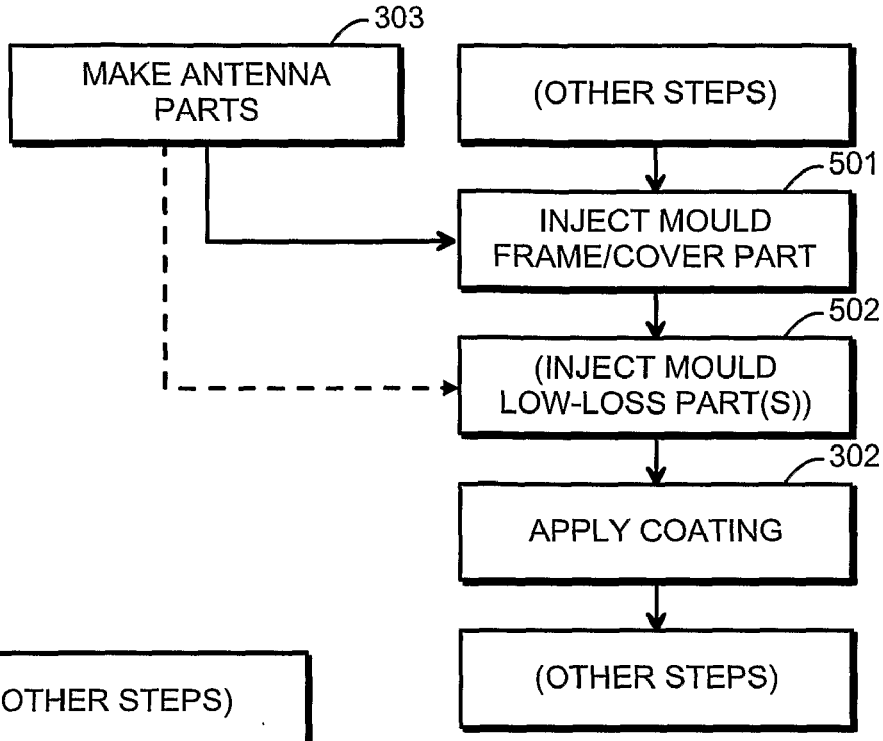
FIG. 5 illustrates another manufacturing method according to an embodiment of the invention.

The method of FIG. 5 involves using at least some of the antenna parts manufactured in step 303 as inserts to the injection molding step in either step 501 or step 502 or both. The method of FIG. 5 covers both the separate manufacturing of a frame part (step 501) and the low-loss thermoplastic patches (step 502), and the combined manufacturing of a complete outer cover part in one step (step 501, in which case step 502 is omitted). Coating is again applied in step 302.

Figure 6:
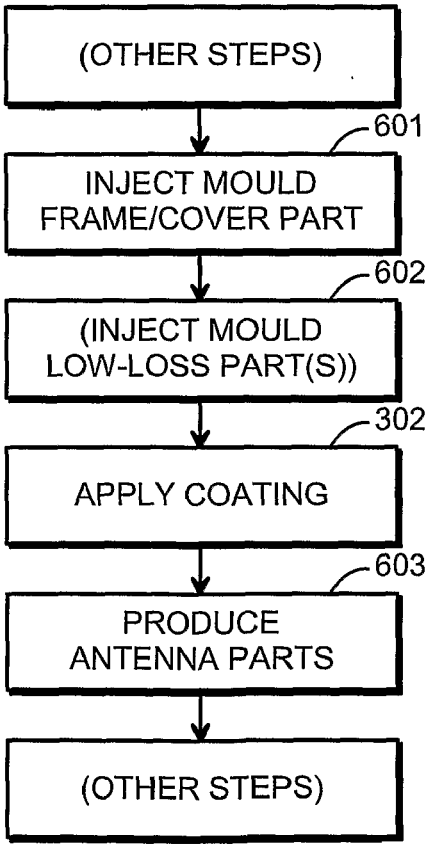
FIG. 6 illustrates another manufacturing method according to an embodiment of the invention.

The method of FIG. 6 is different in that the antenna parts are manufactured directly into an injection molded outer cover part in step 603 (for steps 601 and 602, see steps 501 and 502 above). Step 603 may involve e.g. depositing a metallization to some part(s) of the inner surface of the outer cover part.

Figure 7:
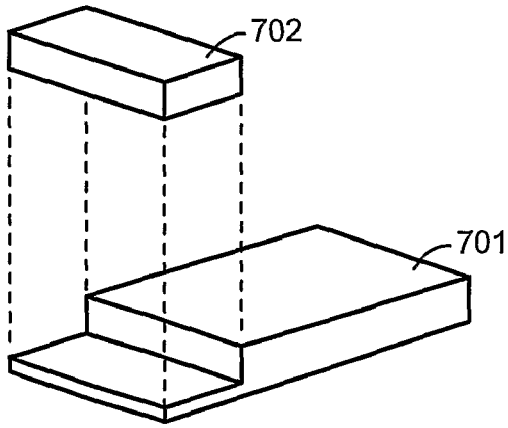
FIG. 7 illustrates a radio frequency module solution.

The invention is not limited to the exemplary embodiments described so far. For example, even if FIGS. 2*a* to 2*b* only show one part of a portable radio device, the invention is not limited to so-called monoblock devices but is equally well applicable to portable radio devices that comprise telescopically extending parts or mutually rotating parts, or have flip covers or other movable outer cover elements. FIG. 7 illustrates how the invention can be applied to a radio frequency module 702 that is meant to be attached to a portable radio device 701. In such a solution what we have said above about manufacturing the parts of a portable radio device apply to the respective ones of the portable radio device 701 and the radio frequency module 702.

The invention claimed is:

1. A portable radio device, comprising:

an outer cover and a radiating antenna element at a location inside said outer cover;

wherein the portable radio device is configured to be holdable by a user;

the outer cover comprises a layered structure at least at a location corresponding to the location of the radiating antenna element, the layered structure comprising a layer of thermoplastic material having a loss tangent value less than 0.005 and a coating that is one of: diamond coating, diamond-like coating, diamond-based nanocomposite coating.

2. A portable radio device according to claim 1, wherein said radiating antenna element is attached to an inner surface of said outer cover.

3. A portable radio device according to claim 1, wherein said layer of thermoplastic material constitutes essentially the whole outer cover.

4. A portable radio device according to claim 3, wherein said coating covers essentially the whole outer surface of the outer cover.

5. A portable radio device according to claim 1, wherein said layer of thermoplastic material constitutes a patch in an outer cover part made of other material.

6. A portable radio device according to claim 5, wherein said coating extends to cover significantly larger parts of the outer cover than said patch.

7. A portable radio device according to claim 5, wherein said coating is limited to co-exist with only said patch.

8. A portable radio device according to claim 1, wherein:

the portable radio device comprises a ground plane, the outer cover comprises, at a location corresponding to the location of the ground plane, thermoplastic material the loss tangent value of which is less than 0.005, and the outer cover comprises, on the outer surface thereof and at a location corresponding to the location of the ground plane, a coating that is one of: diamond coating, diamond-like coating, diamond-based nanocomposite coating.

9. A portable radio device according to claim 1, wherein the outer cover comprises paint or lacquer on an outer surface thereof.

10. An outer cover part for a portable radio device, wherein:

the outer cover part comprises a layered structure at least at a location adapted to correspond to a location of a radiating antenna element in the portable radio device, wherein the layered structure comprises a layer of thermoplastic material having a loss tangent value less than 0.005, and a coating that is one of: diamond coating, diamond-like coating, diamond-based nanocomposite coating.

11. An outer cover part according to claim 10, wherein said thermoplastic material constitutes essentially the whole outer cover part.

12. An outer cover part according to claim 10, wherein said layer of thermoplastic material constitutes a patch in another material that constitutes a frame of the outer cover part.

13. An outer cover part according to claim 10, wherein the outer cover part comprises paint or lacquer on an outer surface thereof.

14. A radio frequency module for a portable radio device, comprising:

an outer cover and a radiating antenna element at a location inside said outer cover;

wherein:

the radio frequency module is configured for a portable radio device that is holdable by a user;

the outer cover comprises a layered structure at least at a location corresponding to the location of the radiating antenna element, the layered structure comprising a layer of thermoplastic material having a loss tangent value less than 0.005, and a coating that is one of: diamond coating, diamond-like coating, diamond-based nanocomposite coating.

15. A radio frequency module according to claim 14, wherein:

the radio frequency module comprises a ground plane, the outer cover comprises, at a location corresponding to a location of the ground plane, thermoplastic material having a loss tangent value less than 0.005, and the outer cover comprises, on an outer surface thereof and at a location corresponding to the location of the ground plane, a coating that is one of: diamond coating, diamond-like coating, diamond-based nanocomposite coating.

16. An antenna structure for a portable radio device, comprising:

an outer cover part and a radiating antenna element at a location inside said outer cover part;

wherein:

the outer cover part comprises a layered structure at least at a location corresponding to the location of the radiating antenna element, the layered structure comprising a layer of thermoplastic material having a loss tangent value less than 0.005, and a coating that is one of: diamond coating, diamond-like coating, diamond-based nanocomposite coating.

17. A method for manufacturing an antenna structure for a portable radio device, comprising:

producing an outer cover part and producing a radiating antenna element at a location inside said outer cover part;

making the outer cover part comprise a layered structure at least at a location corresponding to the location of the radiating antenna element, the layered structure comprising a layer thermoplastic material having a loss tangent value less than 0.005, and coating at least the layered structure with a coating that is one of: diamond coating, diamond-like coating, diamond-based nanocomposite coating.

18. A method according to claim 17, wherein the method comprises producing the outer cover part in an injection molding process and embedding said radiating antenna element into the injection molded material of said outer cover part.

* * * * *